United States Patent [19]

Scavetto

[11] Patent Number: 4,742,701

[45] Date of Patent: May 10, 1988

[54] TRAILER LOCK

[76] Inventor: Donald Scavetto, 106 Hobart Dr., Laurel Springs, N.J. 08021

[21] Appl. No.: 63,498

[22] Filed: Jun. 18, 1987

[51] Int. Cl.[4] ..... E05B 63/14

[52] U.S. Cl. ..... 70/121; 70/54; 292/54; 292/5; 292/DIG. 32; 292/67

[58] Field of Search ..... 70/54, 5 C, 113–114, 70/118, 121, 129; 292/5, 26, 30, 47–48, 67, 54, 104, 148, 191, 192, 202, 205, 207, 281, DIG. 32

[56] References Cited

U.S. PATENT DOCUMENTS

| | | | |
|---|---|---|---|
| 1,065,172 | 6/1913 | Riggs | 292/30 |
| 1,407,755 | 2/1922 | Kennedy | 70/121 |
| 2,562,581 | 7/1951 | Schaefer | 292/47 |
| 3,334,933 | 8/1967 | Erpers | 292/148 |
| 3,572,062 | 3/1971 | Beebe | 292/205 |
| 3,736,016 | 5/1973 | Garvey | 292/281 |
| 3,866,961 | 2/1975 | List | 292/148 |
| 4,290,281 | 9/1981 | Kneack | 70/54 |
| 4,300,369 | 11/1981 | Besecker | 70/54 |
| 4,307,904 | 12/1981 | Daus | 292/148 |
| 4,643,005 | 2/1987 | Logas | 292/5 |

FOREIGN PATENT DOCUMENTS

| | | | |
|---|---|---|---|
| 175659 | 3/1917 | Canada | 70/121 |
| 442114 | 3/1927 | Fed. Rep. of Germany | 70/121 |

*Primary Examiner*—Robert L. Wolfe
*Attorney, Agent, or Firm*—Norman E. Lehrer

[57] ABSTRACT

A door for a trailer, container, garage or similar structure carries a vertically movable elongated rod adjacent its free end. A plurality of pins are pivotally mounted on the rod and are adapted to move into locking apertures located on the structure as the rod moves downwardly into its door locking position. The rod can be moved upwardly and downwardly by a manually operable handle which is accessible from the exterior of the door. The door is also provided with a recess within which is located a key lock mechanism for locking the rod in the downward position. The key lock mechanism includes a vertically aligned keyhole which is accessible only through the recess thereby making access to the keyhole by a screw-driver or the like difficult.

6 Claims, 5 Drawing Sheets

TRAILER LOCK

BACKGROUND OF THE INVENTION

The present invention is directed toward a trailer lock and more particularly toward a tamper-proof locking assembly which is adapted to securely close the door of a truck trailer. While the invention was originally designed for this purpose, it is also useful for securing the door of a freight container, garage or substantially any other similar structure.

As is well known in the art, truck trailer doors must normally be securely locked closed in order to prevent unauthorized entry. This is necessary to prevent theft of merchandise being carried by the truck when the same is parked. A similar problem exists with construction trailers which may be left unattended overnight at a construction site. Such trailers are frequently used to store supplies and equipment.

Such trailers are normally provided with closure mechanisms such as an elongated vertically movable rod carried by the movable door which is adapted to cooperate with an opening in the door frame. Other types of closure mechanisms are also utilized. In most cases, however, the closure mechanism is locked into the closed position by a simple padlock which is passed through a pair of aligned hasps. However, these padlocks are normally totally exposed and can be easily and quickly removed utilizing a hacksaw, hammer or other tools.

There have been proposals set forth in the past to provide a means for guarding or protecting the locks for trailer door closures. Devices of this type are shown, for example, in U.S. Pat. Nos. 3,334,933; 3,736,016; 4,300,369 and 4,307,904. In each of these patents, however, the device is comprised essentially of a housing or other mechanism which is mounted on the exterior face of the door. Thus, with a sledgehammer or other tool, it would appear to be possible in most cases to remove the protective device by destroying the same.

U.S. Pat. No. 3,334,933 shows a second embodiment of a locking device which could be used with a trailer door or the like which is mounted essentially within the door so that substantially no part of the device extends beyond the outer surface thereof. However, in this embodiment of the device, the keyhole of the padlock is readily and easily exposed through an opening thereby making it possible to either pick or otherwise destroy the lock utilizing a screwdriver or other tool.

SUMMARY OF THE INVENTION

The present invention is designed to overcome the deficiencies of the prior art described above. It provides a locking and security system which is essentially vandal proof. According to the invention, a door for a trailer, container, garage or similar structure carries a vertically movable elongated rod adjacent its free end. A plurality of pins are pivotally mounted on the rod and are adapted to move into locking apertures located on the structure as the rod moves downwardly into its door locking position. The rod can be moved upwardly and downwardly by a manually operable handle which is accessible from the exterior of the door. The door is also provided with a recess within which is located a key lock mechanism for locking the rod in the downward position. The key lock mechanism includes a vertically aligned keyhole which is accessible only through the recess thereby making access to the keyhole by a screwdriver or the like difficult.

BRIEF DESCRIPTION OF THE DRAWINGS

For the purpose of illustrating the invention, there are shown in the accompanying drawings forms which are presently preferred; it being understood that the invention is not intended to be limited to the precise arrangements and instrumentalities shown.

DETAILED DESCRIPTION OF THE PREFERRED EMBODIMENTS

Figure 1:
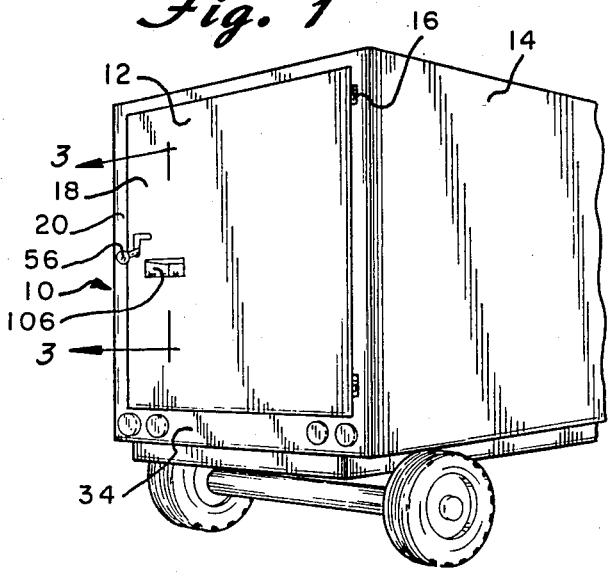
FIG. 1 is a perspective view of the rear of a trailer illustrating the use of the present invention.

Referring now to the drawings in detail wherein like reference numerals have been used throughout the various figures to designate like elements, there is shown in FIG. 1 a trailer lock constructed in accordance with the principles of the present invention and designated generally as 10. The locking device 10 is shown in FIG. 1 in use on a door 12 of a truck trailer 14. The door 12 is hinged at its right side as viewed in FIG. 1 by hinges 16 so that it can be moved between an open position wherein the rear wall of the trailer 14 is exposed and a closed position such as shown in FIG. 1. The locking mechanism 10 is carried by the door 12 adjacent the free edge 18 thereof. As will be shown more clearly below, the locking mechanism 10 cooperates with the left wall 20 of the trailer 14 to lock the door 12 in its closed position.

Figure 2:
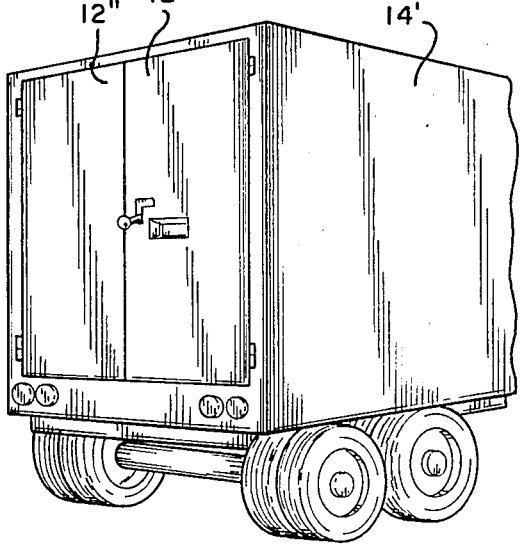
FIG. 2 is a view similar to FIG. 1 but showing a trailer with double doors utilizing the invention.

The trailer 14' shown in FIG. 2 may be similar to trailer 14. However, trailer 14' includes a pair of doors 12' and 12" at the rear thereof. It should be readily apparent to those skilled in the art that the locking mechanism of this invention is readily adaptable to this type of arrangement. The locking device 10' of FIG. 2 which is carried by door 12' will cooperate with the door 12" rather than with the left side wall of the trailer as with the embodiment shown in FIG. 1. The trailers 14 and 14' shown in FIGS. 1 and 2 are, of course, by way of example only since the invention is equally applicable to other similar types of equipment or structures such as trucks, containers, garages or the like and with some minor modifications to overhead truck or garage doors.

Referring now generally to FIGS. 3–7, the locking device 10 includes a vertically movable elongated rod 22. The rod 22 is mounted to a slide housing 24 through a plurality of bolts 26. As shown most clearly in FIG. 3, the slide housing 24 is carried by the door 12 adjacent its free end thereof so that the housing 24 substantially abuts the left side wall 20 when the door is in its closed position. In order to permit the rod 22 to move vertically, the same is provided with a plurality of elongated slots 28 through which the bolts 26 pass.

Figure 6:
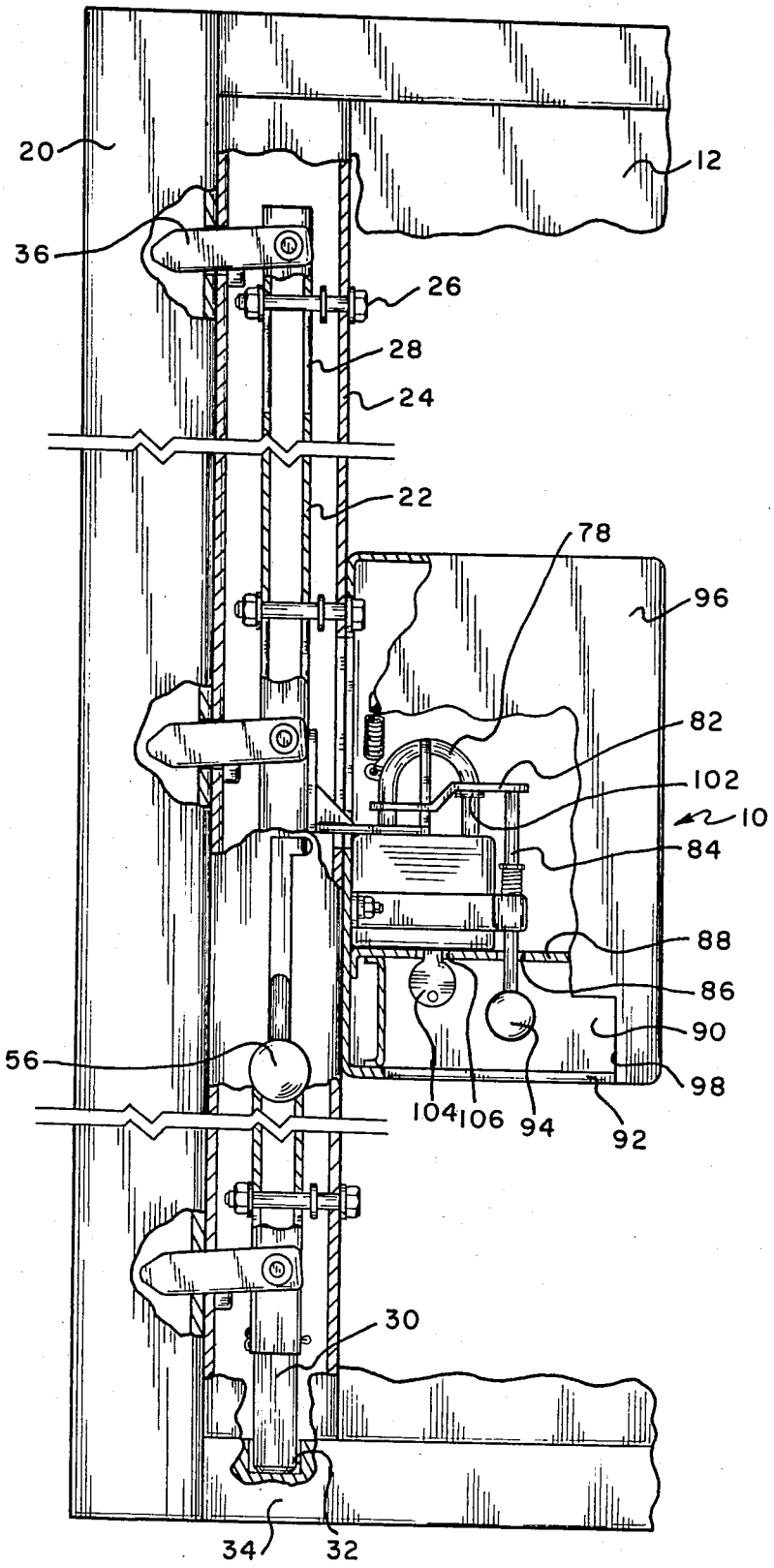
FIG. 6 is a cross-sectional view taken through the line 6—6 of FIG. 4.
Figure 7:
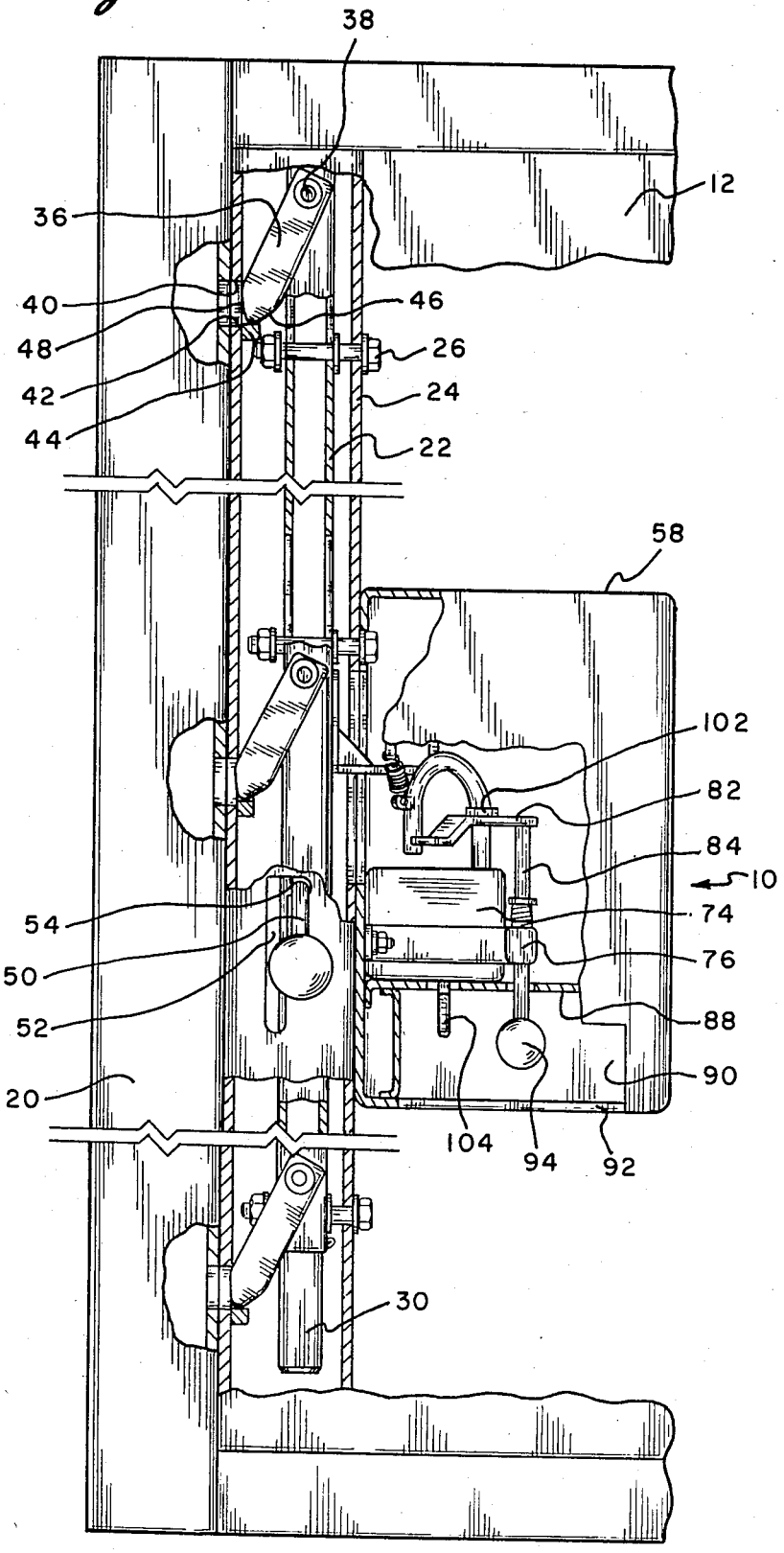
FIG. 7 is a cross-sectional view taken through the line 7—7 of FIG. 5.

The lowermost end of the rod 22 carries a pin 30 which moves upwardly or downwardly as the rod is moved. When the rod 22 is in its downwardly most position as shown in FIG. 6, the bottom of the pin 30 enters the recess 32 in the bottom wall 34 which functions to lock the door 12 in its closed position. When the rod 22 is raised, the pin 30 moves upwardly out of the recess 32 as shown in FIG. 7.

Rod 22 also carries a plurality of pins 36 which are pivotally attached to the rod through bolts or rivets or the like 38. While three such pins 36 are shown in FIGS. 6 and 7, it should be understood that substantially any number may be employed. Furthermore, each of the pins functions in the same manner as the others. Accordingly, a description of one will be understood to apply to each of the pins.

Adjacent each of the pins 36 are a plurality of aligned pin apertures 40 and 42. Aperture 40 is formed in the wall of the slide housing 24 and aperture 42 is formed in the inner surface of the left side wall 20. As shown most clearly in FIG. 6, the pin apertures 40 and 42 are slightly larger than the height of the pins 36 so that they can be easily inserted into and withdrawn from the apertures.

A guide block 44 is located on the inner wall of the slide housing 24 immediately adjacent the bottom of the aperture 40 and the forward end of each of the pins 36 is rounded at both its top and bottom to form cam surfaces 46 and 48. When the rod 22 is in its upward or open position as shown in FIG. 7, the pins 36 are withdrawn from the apertures 40 and 42 and the cam surface 46 rests on the guide block 44. In this position, the door 12 could be opened. As the rod 22 is moved downwardly, the guide blocks 44 guide the cam surface 46 and thus the pin 36 into the apertures 40 and 42 until they are fully inserted therein as shown in FIG. 6. FIG. 6 illustrates the locked position wherein the door 12 is prevented from being opened.

In order to move the rod 22 upwardly and downwardly, the same is provided with a lifting bar 50 which is rigidly secured to the rod 22 and which extends rearwardly through a slot 52 in the outer surface of the door 12 so as to be accessible from the exterior of the door. The slot 52 is essentially vertically aligned and has a vertical height which is substantially equal to the length of travel of the rod 22 from the uppermost vertical open position as shown in FIG. 7 to the lower and locking position shown in FIG. 6. The upper end of the slot 52 has a horizontally extending notch 54 formed therein so that the lifting bar 50 can be forced into this notch to maintain the rod 22 in the raised open position when desired. A handle 56 is provided at the end of the lifting rod 50 to assist an operator in moving the rod.

Figure 3:
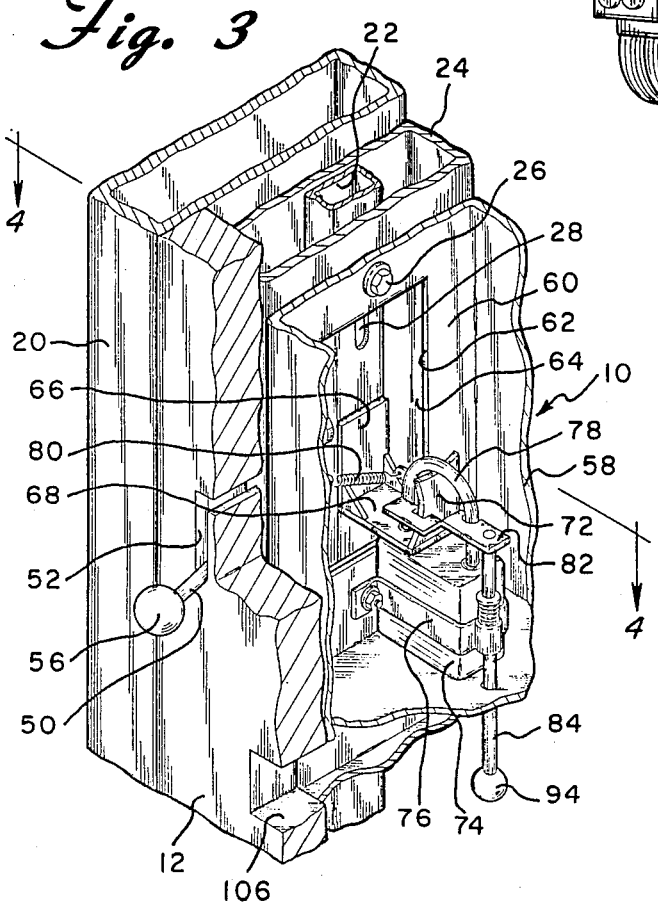
FIG. 3 is a cross-sectional view taken through the line 3—3 of FIG. 1.

In order to positively lock the rod 22 in its downward locking position, the locking device 10 is also provided with a key lock mechanism which is essentially located within the lock box 58 located behind the door 12 and immediately adjacent the slide housing 24. The lock box 58 includes a left side wall 60 which is secured to the slide housing 24 and which includes an opening 62 therein which coincides with a similar opening 64 in the side wall of the slide housing 24 so as to expose a portion of the rod 22. A hasp bracket 66 is welded to the rod 22 and includes a horizontal portion 68 which extends into the interior of the lock box 58. As shown most clearly in FIG. 5, the horizontal portion 68 includes an aperture 70 therein. The hasp bracket 66 also includes a vertically extending wall 72 adjacent its free end thereof as is best shown in FIG. 3.

Figure 4:
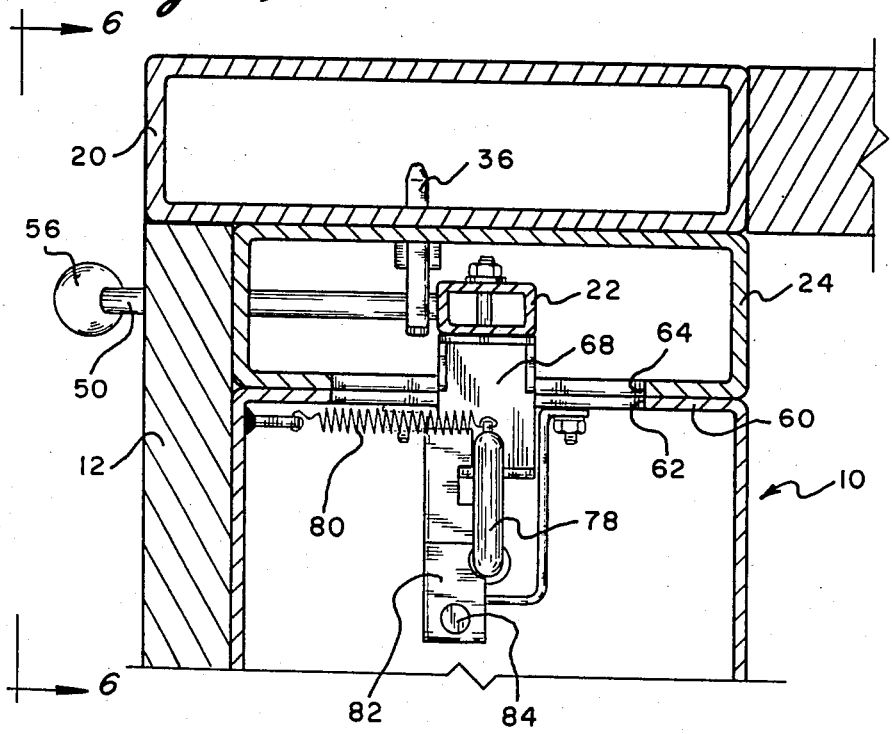
FIG. 4 is a cross-sectional view taken through the line 4—4 of FIG. 3.
Figure 5:
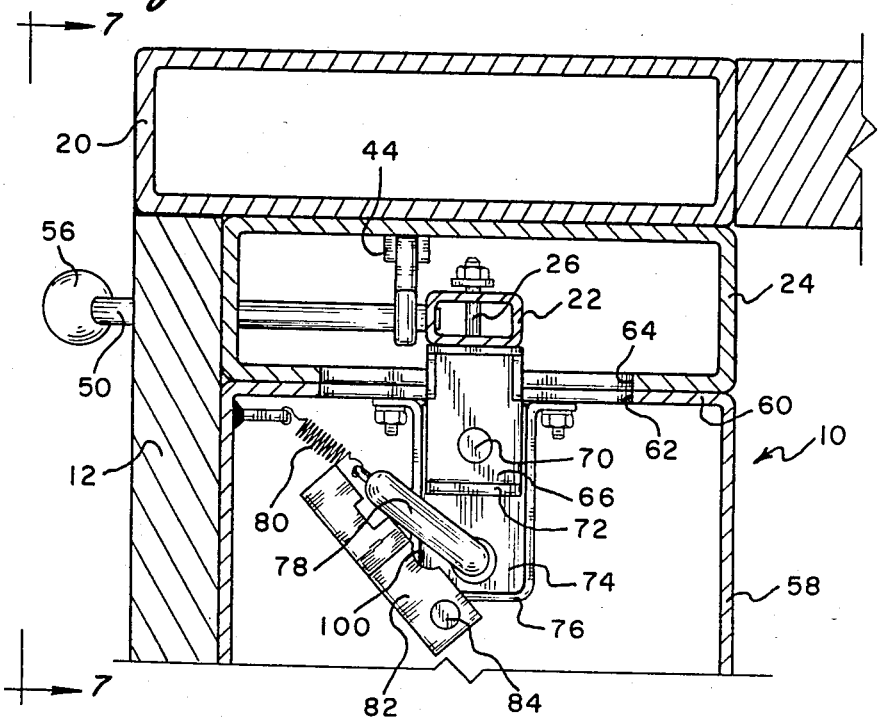
FIG. 5 is a view similar to FIG. 4 but showing the lock in its open position.

Also located within the lock box 58 is a substantially conventional padlock 74 which is secured to the side wall 60 of the lock box 58 through the use of a bracket 76. Padlock 74 includes a shackle 78 which is normally biased into the open position shown in FIG. 5 through the use of spring 80. When the shackle 78 is in the open position as shown in FIG. 5, hasp bracket 66 is unobstructed and is free to move upwardly. Thus, the rod 22 is free to be moved upwardly through the use of the lifting bar 50. However, when the shackle 78 is in the position shown in FIGS. 3 and 4 where it overlies the end of the hasp bracket 66, the shackle can be moved downwardly so that the free end of the same passes through the aperture 70 in the horizontal portion 68 of the hasp bracket and is locked into the padlock 74. In this position, as best shown in FIG. 3, the upper end of the vertical wall 72 directly underlies the center portion of the shackle 78 thereby preventing upward movement of the hasp bracket 66 and, therefore, the rod 22.

The shackle 78 can be moved manually into its locking position against the force of the spring 80 through the use of the alignment bracket 82. Alignment bracket 82 is carried at the top of the vertically extending lock bar 84. Lock bar 84 is pivotally supported by the bracket 76 and passes downwardly through opening 86 in the intermediate horizontal wall 88 of the lock box 58. The lowermost end of the lock bar 84 extends into the chamber 90 between the intermediate wall 88 and the lowermost wall 92 of the lock box and terminates in a handle 94. As shown most clearly in FIGS. 6 and 7, the front wall 96 of the lock box 58 includes a cutout portion forming an opening 98 through which the handle 94 is accessible.

When it is desired to move the shackle 78 into its closed position, handle 94 is moved upwardly so that the cutout portion 100 (FIG. 5) in the alignment bracket 82 is above the height of the locking ring 102 which is welded or otherwise secured to the shackle 78 as shown in FIGS. 6 and 7. The handle 94 and thus the alignment bracket 82 are then rotated clockwise as shown in FIGS. 4 and 5 until the free end of the shackle 78 overlies the aperture 70 in the hasp bracket 66. In this position, the cutout portion 100 of the alignment bracket 82 engages the shackle 78 and directly overlies the locking ring 102. The handle 94 is then pulled downwardly thereby forcing the alignment bracket 82 downwardly which, in turn, pulls the shackle 78 downwardly through the aperture 70 to be locked by the padlock 74.

The padlock 74 can be opened utilizing key 104. As shown in FIGS. 6 and 7, the intermediate wall 88 of the lock box 58 also includes an opening 106 therein which directly underlies the vertically aligned keyhole in the padlock 74. The key 104 can be manually inserted into the keyhole through the opening 98 in the front wall 96 of the lock box.

Since the lock box 58 is located behind the door 12, means must be provided for manual access to the chamber 90. This is accomplished by forming an opening 106 through the door 12. Opening 106 is of substantially the same size as and is in direct alignment with the opening 98 in the front wall 96 of the lock box. As a result, access from the outside of the door 12 through the opening 106 is limited to the chamber 90. As a result of this arrangement, an operator can insert his hand through the opening 106 into the chamber 90 so as to operate the handle 94 or to insert the key 104 into the padlock but the padlock itself and the other elements needed to lock the rod 22 into its downward position are totally inaccessible from the exterior of the door 12.

Figure 8:
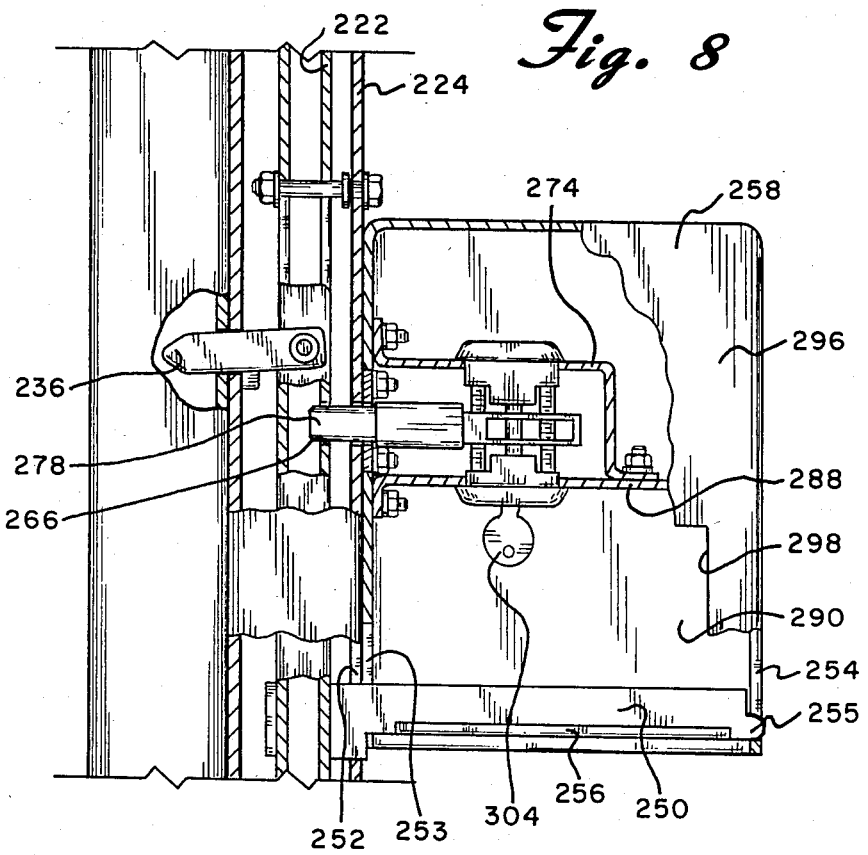
FIG. 8 is a cross-sectional view similar to FIG. 6 but showing a second embodiment of the invention.
Figure 9:
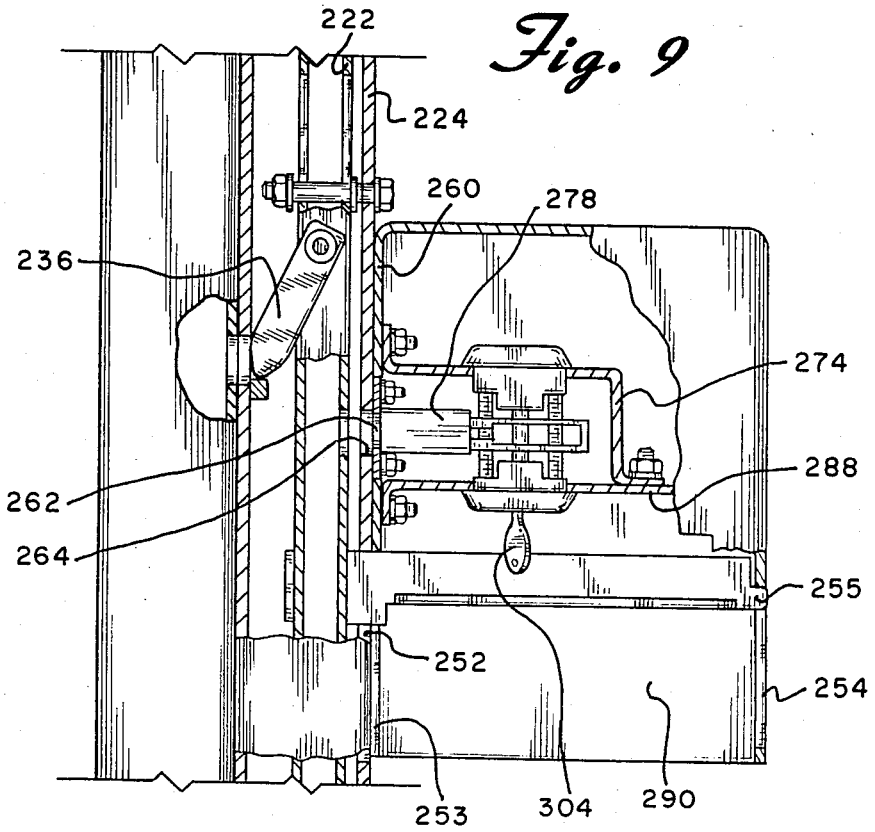
FIG. 9 is a cross-sectional view similar to FIG. 8 but showing the device in the unlocked position.

A second embodiment of the invention is illustrated in FIGS. 8 and 9. In this embodiment, the rod 222 and pins 236 function in substantially the same manner and for the same purposes as the corresponding parts 22 and 36 of the first embodiment. The lock box 258 is also located in substantially the same position on a trailer door as the lock box 58 of the first embodiment. Accordingly, the differences between the second embodiment and the first embodiment will be described.

In lieu of the lifting bar 50 of the first embodiment which extends outwardly through the door 12, the invention of this embodiment includes a lifting bar 250 which is also welded or otherwise secured to the vertically movable rod 222 but which extends horizontally through appropriate slots 252 and 253 in the slide housing 224 and lock box 258, respectively. The lifting bar 250 extends into the chamber 290 of the lock box 258 and terminates in a small tab 255 which is guided by slot 254 formed in the right side wall of the lock box 258. Slot 254 also includes a horizontal notch adjacent the top thereof which can be used to maintain the lifting bar 250 in its raised position (similar to notch 54). The lifting bar 250 is also provided with a horizontally extending portion 256 which functions as a handle. The lifting bar 250 is accessible from the exterior of the trailer only through the opening 298 in the front wall 296 and through a similarly situated opening in the door.

In lieu of the padlock 74 of the first embodiment, this embodiment of the invention utilizes a substantially conventional dead bolt lock 274. Dead bolt lock 274 is mounted within the lock box 258 above the intermediate wall 288 so that the keyhole thereof is vertically aligned and is accessible from the chamber 290 whereby the key 304 can be inserted therein.

The bolt 278 of the dead bolt lock 274 is adapted to be moved horizontally by turning the key 304 between the locking position shown in FIG. 8 wherein the bolt extends outwardly and the unlocked position shown in FIG. 9 wherein the bolt is withdrawn into the lock. The left side wall 260 of the lock box 258 is provided with a suitable opening 262 therein to accommodate the bolt 278. A similar opening 264 is formed in the slide housing 224. As shown most clearly in FIG. 8, the rod 222 is also provided with an opening 266. When the rod 222 is in its lowermost position as shown in FIG. 8, the openings 262, 264 and 266 are in alignment with each other and the bolt 278 can pass therethrough to lock the rod 222 in its lowermost locked position.

The present invention may be embodied in other specific forms without departing from the spirit or essential attributes thereof and accordingly reference should be made to the appended claims rather than to the foregoing specification as indicating the scope of the invention.

I claim:

1. In a truck, container, garage or similar structure having a compartment therein and an opening in one wall thereof adapted to be closed by a door and including a door movable between an open and a closed position, the improvement comprising:

a vertically movable elongated rod means carried by said door adjacent an edge thereof;

a plurality of pins pivotally mounted on said rod means;

a plurality of pin apertures in said structure adjacent said door edge and means for guiding said pins into said pin apertures as said rod means moves downwardly to lock said door in said closed position, said guide means guiding said pins out of said pin apertures as said rod means is moved upwardly to allow said door to be opened;

said rod means, said pins and said pin apertures being inaccessible from the exterior of said structure;

a lifting bar rigidly secured to said rod means, said lifting bar being accessible from the exterior of said door and being adapted to be manually moved upwardly or downwardly to thereby move said rod means upwardly or downwardly;

a key lock mechanism carried by said door and located behind the outer surface thereof, said lock mechanism having a locking element movable between a locking position and an unlocked position, said locking element cooperating with said rod means to lock the same downwardly when said locking element is moved into its locking position;

said lock mechanism having a keyhole arranged in an axis which is substantially parallel to the plane of said door, and a recess within said door, said keyhole being accessible from the exterior of said door through said recess.

2. The invention as claimed in claim 1 wherein said lifting bar extends from said rod means rearwardly to the exterior of said door.

3. The invention as claimed in claim 1 wherein said rod means includes a bracket extending substantially perpendicularly therefrom and wherein said locking element of said key lock mechanism cooperates with said bracket.

4. The invention as claimed in claim 1 wherein said lifting bar extends from said rod means sidewardly into said recess.

5. The invention as claimed in claim 1 wherein said key lock mechanism includes a dead bolt lock and wherein the dead bolt of said dead bolt lock is adapted to cooperate with said rod means to lock the same.

6. The invention as claimed in claim 5 wherein said rod means includes an opening therein adapted to cooperate with said dead bolt.

* * * * *